US008925638B2

(12) United States Patent
Wygnanski

(10) Patent No.: US 8,925,638 B2
(45) Date of Patent: Jan. 6, 2015

(54) GAS INJECTION CONTROL DEVICES AND METHODS OF OPERATION THEREOF

(75) Inventor: Wladyslaw Wygnanski, Cambridge (GB)

(73) Assignee: Camcon Oil Limited, Cambridge (GB)

( * ) Notice: Subject to any disclaimer, the term of this patent is extended or adjusted under 35 U.S.C. 154(b) by 702 days.

(21) Appl. No.: 12/995,754

(22) PCT Filed: Jun. 5, 2009

(86) PCT No.: PCT/GB2009/050629

§ 371 (c)(1),
(2), (4) Date: Dec. 22, 2010

(87) PCT Pub. No.: WO2009/147446

PCT Pub. Date: Dec. 10, 2009

(65) Prior Publication Data

US 2011/0083855 A1 Apr. 14, 2011

(30) Foreign Application Priority Data

Jun. 7, 2008 (GB) ..... 0810473.9

(51) Int. Cl.
*E21B 34/10* (2006.01)
*E21B 34/00* (2006.01)
*E21B 43/12* (2006.01)

(52) U.S. Cl.
CPC ..... *E21B 43/123* (2013.01)
USPC ..... 166/372; 166/334.4; 166/316

(58) Field of Classification Search
USPC ..... 166/372, 373, 316, 334.4
See application file for complete search history.

(56) References Cited

U.S. PATENT DOCUMENTS 3,362,347 A * 1/1968 Canalizo ..... 417/117
4,135,576 A * 1/1979 Tausch ..... 166/117.5
4,635,855 A 1/1987 Kuyel et al.

(Continued)

FOREIGN PATENT DOCUMENTS

FR 2875638 A1 3/2006
GB 2342504 4/2000

(Continued)

OTHER PUBLICATIONS

International Search Report and Written Opinion for corresponding International Application No. PCT/GB2009/050629, dated Feb. 5, 2010.

(Continued)

*Primary Examiner* — Brad Harcourt
(74) *Attorney, Agent, or Firm* — Marshall, Gerstein & Borun LLP

(57) ABSTRACT

Gas injection control devices are provided, particularly for deployment in a well-bore to control injection of a gas into a tube or pipe to lift a liquid up the tube, such as crude oil for example. A gas control device is described which comprises a housing, and at least two control valve arrangements within the housing. Each arrangement has an inlet for receiving gas from a pressurized supply, an outlet for supplying pressurized gas for injection into the tube, an inlet valve in a fluid path between the inlet and outlet, and an actuator associated with the inlet valve. Each actuator is independently controllable to switch the respective inlet valve between its open and closed configurations. This allows the gas injection to be switched on and off, and facilitates control of the injection gas flow rate.

21 Claims, 10 Drawing Sheets

(56) References Cited

U.S. PATENT DOCUMENTS

| | | | | |
|---|---|---|---|---|
| 5,172,717 | A | 12/1992 | Boyle et al. | |
| 5,937,945 | A * | 8/1999 | Bussear et al. | 166/250.15 |
| 6,148,843 | A | 11/2000 | Pringle | |
| 6,598,621 | B1 | 7/2003 | Wygnanski | |
| 7,360,602 | B2 * | 4/2008 | Kritzler et al. | 166/372 |
| 2002/0043369 | A1 | 4/2002 | Vinegar et al. | |
| 2005/0109542 | A1 * | 5/2005 | Downton | 175/73 |
| 2007/0181312 | A1 | 8/2007 | Kritzler et al. | |
| 2009/0020293 | A1 * | 1/2009 | Richards | 166/381 |

FOREIGN PATENT DOCUMENTS

| | | | |
|---|---|---|---|
| GB | 2380065 | | 3/2003 |
| RU | 2273727 | | 4/2006 |
| SU | 1630366 | A1 | 7/1997 |
| WO | WO-00/75484 | A1 | 12/2000 |
| WO | WO-00/79097 | A1 | 12/2000 |
| WO | WO-01/06130 | A1 | 1/2001 |
| WO | WO-01/65055 | A1 | 9/2001 |

OTHER PUBLICATIONS

United Kingdom Search Report for corresponding UK Application No. GB0810473.9, dated Sep. 29, 2009.

Search Report from corresponding Eurasian patent application No. EA201071394, dated Apr. 1, 2011.

European Search Report from corresponding European application No. 09787818.1, dated Jun. 7, 2011.

* cited by examiner

| Bit 7 | Bit 6 | Bit 5 | Bit 4 | Bit 3 | Bit 2 | Bit 1 | Bit 0 | Description |
|---|---|---|---|---|---|---|---|---|
| | V7 | V6 | V5 | V4 | V3 | V2 | V1 | |
| | D/V | 30% | 30% | 15% | 15% | 5% | 5% | |
| | | | | | | | | 0% |
| | | | | | | | 1 | 5% |
| | | | | | | 2 | 1 | 10% |
| | | | | | 3 | | | 15% |
| | | | | | 3 | | 1 | 20% |
| | | | | | 3 | 2 | 1 | 25% |
| | | | 5 | | | | | 30% |
| | | | 5 | | | | 1 | 35% |
| | | | 5 | | | 2 | 1 | 40% |
| | | | 5 | | 3 | | | 45% |
| | | | 5 | | 3 | | 1 | 50% |
| | | | 5 | | 3 | 2 | 1 | 55% |
| | | 6 | 5 | | | | | 60% |
| | | 6 | 5 | | | | 1 | 65% |
| | | 6 | 5 | | | 2 | 1 | 70% |
| | | 6 | 5 | | 3 | | | 75% |
| | | 6 | 5 | | 3 | | 1 | 80% |
| | | 6 | 5 | | 3 | 1 | 1 | 85% |
| | | 6 | 5 | 4 | 3 | | | 90% |
| | | 6 | 5 | 4 | 3 | | 1 | 95% |
| | | 6 | 5 | 4 | 3 | 2 | 1 | 100% |
| | 7 | | | | | | | Unloading unit |

FIG. 8

| V6 | V5 | V4 | V3 | V2 | V1 | |
|---|---|---|---|---|---|---|
| 16.7% | 16.7% | 16.7% | 16.7% | 16.7% | 16.7% | Flow rate |
| | | | | | | 0% |
| | | | | | 1 | 16.7% |
| | | | | 2 | 1 | 33.4% |
| | | | 3 | 2 | 1 | 50.1% |
| | | 4 | 3 | 2 | 1 | 66.8% |
| | 5 | 4 | 3 | 2 | 1 | 83.5% |
| 6 | 5 | 4 | 3 | 2 | 1 | 100% |

FIG. 9

GAS INJECTION CONTROL DEVICES AND METHODS OF OPERATION THEREOF

CROSS-REFERENCE TO RELATED APPLICATIONS

This is the U.S. national phase of International Application No. PCT/GB2009/050629, filed Jun. 5, 2009, which claims the benefit of United Kingdom Patent Application No. 0810473.9, filed Jun. 7, 2008.

FIELD OF THE INVENTION

The present invention relates to gas injection control devices, particularly for deployment in a well-bore to control injection of a gas into a tube or pipe to lift a liquid up the tube, such as crude oil for example.

BACKGROUND TO THE INVENTION

In known oil extraction techniques, gas is injected into a tube of crude oil to lift the oil up the tube where the oil reservoir pressure itself is insufficient to do so, or to increase the oil flow rate further. This technique is often referred to as "gas lift". Pressured gas is supplied to the annulus between the outside well-bore casing and the inner production tubing string and injected into the base of the liquid column in the tubing string through a down-hole gas lift valve. The effect is to aerate the crude oil, reducing its density and causing the resultant gas/oil mixture to flow up the tubing.

A known form of gas lift oil well configuration is depicted schematically in FIG. 1. Pressurized gas is supplied by a compressor station 2 to an injection gas manifold 4. The manifold splits the gas supply into four separate feeds for respective wells 6. Each well includes an outer well-bore casing 8 surrounding an inner production tubing string or pipe 10. The gas is fed into the annulus 12 defined between the casing and tubing string. The gas is then injected into the tubing string close to its base via a gas lift valve 14.

Crude oil 16 is drawn up the tubing string and mixes with the injected gas as the mixture is lifted upwards. The mixture is fed out of the well head 16 to a production manifold 18 where it is combined with the supplies of the other wells 6. The combined mixture is fed to gas/oil separator 20. Here, the injected gas is separated from the oil and fed to compressor station 2 for re-compression and re-injection. The extracted oil is fed to storage 22, before onward supply along pipeline 24.

The amount of gas to be injected into a particular well to maximise oil production varies according to a number of factors, such as the well conditions and geometries. The liquid protection rate will also vary depending on the viscosity of the extracted liquid and the geographical location of the well itself. A graph illustrating a typical relationship between gas injection rate and liquid production rate is shown in FIG. 2. This form of graph is commonly referred to as a "gas lift performance curve", and is generated on the basis of a constant injection pressure of the gas. Too much or too little injected gas will result in deviation from the most efficient production state. The primary aim of optimization is to ensure that lift gas is applied to each individual well at a rate which achieves the maximum production from the field, whilst minimising the consumption of compressed gas. In the example shown, the production rate is optimized at a gas injection rate of around 0.9 MMscf/d (million standard cubic feet per day) and a gas injection valve orifice size would be selected accordingly.

In existing gas lift configurations, the gas lift valve has an orifice diameter selected to maximise production from a given well based on the gas pressure supplied to the well. However, if circumstances change and a different gas flow rate is desired to optimize production, it is necessary to halt production before the orifice can be replaced by one of the desired diameter. An "unloading" procedure must then be carried out to resume production.

Unloading the well-bore is a laborious process, as will be apparent from the following discussion with reference to FIGS. 3A to 3C. Several gas injection valves are used to provide different pressure-controlled stages to sequentially remove static fluid from the annulus during gas lift start-up. In addition to gas lift valve 14, the well-bore depicted has unloading valves 30,32. Initially, the injection pressure depresses the liquid level in the annulus between the outer well-bore casing 8 and the inner production tubing string 10, flushing out the annulus 12 until valve 30 is uncovered as shown in FIG. 3B. At this point, gas is injected in to the inner tubing 10 via valve 30, decreasing the tubing pressure. As the inner tubing pressure drops, the liquid level in the annulus 12 also drops. At the point where valve 32 is uncovered as shown in FIG. 3C, gas is injected into the inner tubing 10 via valve 32 and valve 30 is shut off. This continues until the unloading process is completed.

In practice, the unloading and gas lift valves are often provided in side mandrels, as shown in FIG. 4. Each mandrel 40 is usually formed with the tubing string deployed in a well-bore using "kick-over" tools to physically deform the sidewall of the tubing, which is itself a time-consuming and difficult procedure. Each valve 30, 32 and 14 is installed in a respective mandrel 40. A packer 42 is provided at the base of the annulus 12 and acts as a seal between the oil producing rock formation surrounding the well-bore, the casing 8 and the tubing 10 to prevent gas from entering the producing zone.

To change the orifice size of the gas lift valve 14, it is necessary to terminate gas injection and halt oil production. Slick line trips are used to change the gas lift valve and replace it with one having a different orifice diameter. To resume gas injection, the unloading process is repeated.

It will be appreciated that any modification to existing configurations will need to be able to survive a long time (typically 5 to 10 years) in very harsh conditions underground, at depths of around 1 km or more. The ambient pressure will be very high (200 bar or more) and high temperatures are likely to be experienced.

SUMMARY OF THE INVENTION

The present invention provides a gas injection control device for deployment in a well-bore to control injection of gas into a tube containing crude oil to lift the oil up the tube, comprising a housing, and at least two control valve arrangements within the housing, each arrangement having:

- an inlet for receiving gas from a pressurized supply;
- an outlet for supplying pressurized gas for injection into said tube;
- an inlet valve in a fluid path between the inlet and outlet; and
- an actuator associated with the inlet valve, each actuator being independently controllable to switch the respective inlet valve between its open and closed configurations.

Such a device enables variation of the rate of gas injection at a given depth into a production tubing string without needing to halt oil production. Furthermore, gas injection can be turned on and off as required, without disturbing the annulus pressure environment surrounding the tubing string. This provides operational flexibility that is not available from known gas lift deployments.

Preferably, at least two control valve arrangements are provided which are configured to supply gas at different respective flow rates at their outlets when their inlets are connected to a common gas supply pressure. More particularly, each of two of the control valve arrangements may be one of a pair, with the arrangements in each pair being configured to supply gas at substantially the same flow at their outlets. This element of redundancy provides a backup should one of the arrangements fail.

A preferred embodiment includes three pairs of control valve arrangements, wherein each arrangement of the first, second and third pairs is configured to supply approximately 5%, 15% and 30% of the maximum flow rate of the device, respectively. This combination allows the percentage of the maximum flow rate which is passed by the control device to be selected at 5% increments.

Alternatively, it may be preferable to provide six control valve arrangements, each configured to supply approximately one sixth of the maximum flow rate. In other arrangements, other combinations of flow rates from six or another number of control valve arrangements may be deployed, depending on the user's requirements, and this flexibility is facilitated by the invention.

The housing may be designed for insertion in the annulus between the outer well-bore casing and the inner tubing string without requiring deformation of the tubing string to accommodate it. Preferably, the housing is arranged for deployment around the outside of the tubing string. It may have a substantially annular configuration, for example.

In other embodiments, the device is arranged for insertion into the production tubing string, between portions of the tube, with the device defining a path therethrough for the oil to flow along as it travels from one tube portion to the other.

Each control valve arrangement may include a safety valve in the fluid path between its outlet and the inlet valve, with the safety valve arranged so as to inhibit fluid from flowing into the arrangement via its outlet.

In preferred embodiments the control device may include an additional unloading valve arrangement for selectively supplying gas to the tubing string at a substantially higher flow rate than the control valve arrangement. Unloading and gas lift valves are thereby conveniently provided in a common device. The unloading valve may be employed intermittently to inject gas at a high rate. Alternatively, unloading may be achievable by opening all the control valve arrangements.

The present invention further provides a method for controlling injection of gas into a tube containing crude oil to lift the oil up the tube, comprising the steps of:

- providing at least two control valve arrangements, each having an inlet for receiving gas from a pressurized supply, an outlet for supplying pressurized gas for injection into the tube, an inlet valve in a fluid path between the inlet and outlet, and an actuator associated with the inlet valve, each actuator being independently controllable to switch the respective inlet valve between its open and closed configurations;
- coupling the outlet of each arrangement to the interior of the tube; and
- selectively operating each actuator so as to inject gas into the tube at a desired combined rate.

Preferably, the method includes the further steps of monitoring the output flow rate of the tube, and adjusting the rate of injection of gas into the tube in response to the monitored output flow rate. In this way, the rate of gas injection may be adjusted to optimize the rate of hydrocarbon extraction on a well-by-well basis, without interrupting the production process.

Furthermore, the present invention provides a method for controlling the extraction of crude oil via multiple tubes, comprising the steps of:

- providing in association with each tube at least two control valve arrangements, each having an inlet for receiving gas from a pressurized supply, an outlet for supplying pressurized gas for injection into the respective tube, an inlet valve in a fluid path between the inlet and outlet, and an actuator associated with the inlet valve, each actuator being independently controllable to switch the respective inlet valve between its open and closed configurations;
- coupling the outlet of each arrangement to the interior of the respective tube;
- selectively operating each actuator so as to inject gas into the respective tube at a desired rate;
- monitoring the output flow rate of each tube; and
- adjusting the rate of injection of gas into at least one tube in response to the monitored output flow rates. Accordingly, gas lift operations may be optimized across groups of wells or even entire fields. Injection rates at wells in the same field may be co-ordinated to optimize the overall field production rate.

BRIEF DESCRIPTION OF THE DRAWINGS

Prior art and embodiments of the invention will now be described by way of example with reference to accompanying schematic drawings wherein:

FIGS. 8 and 9 are tables indicating control sequences for two alternative valve control device configurations;

DETAILED DESCRIPTION OF THE DRAWINGS

Figure 1:
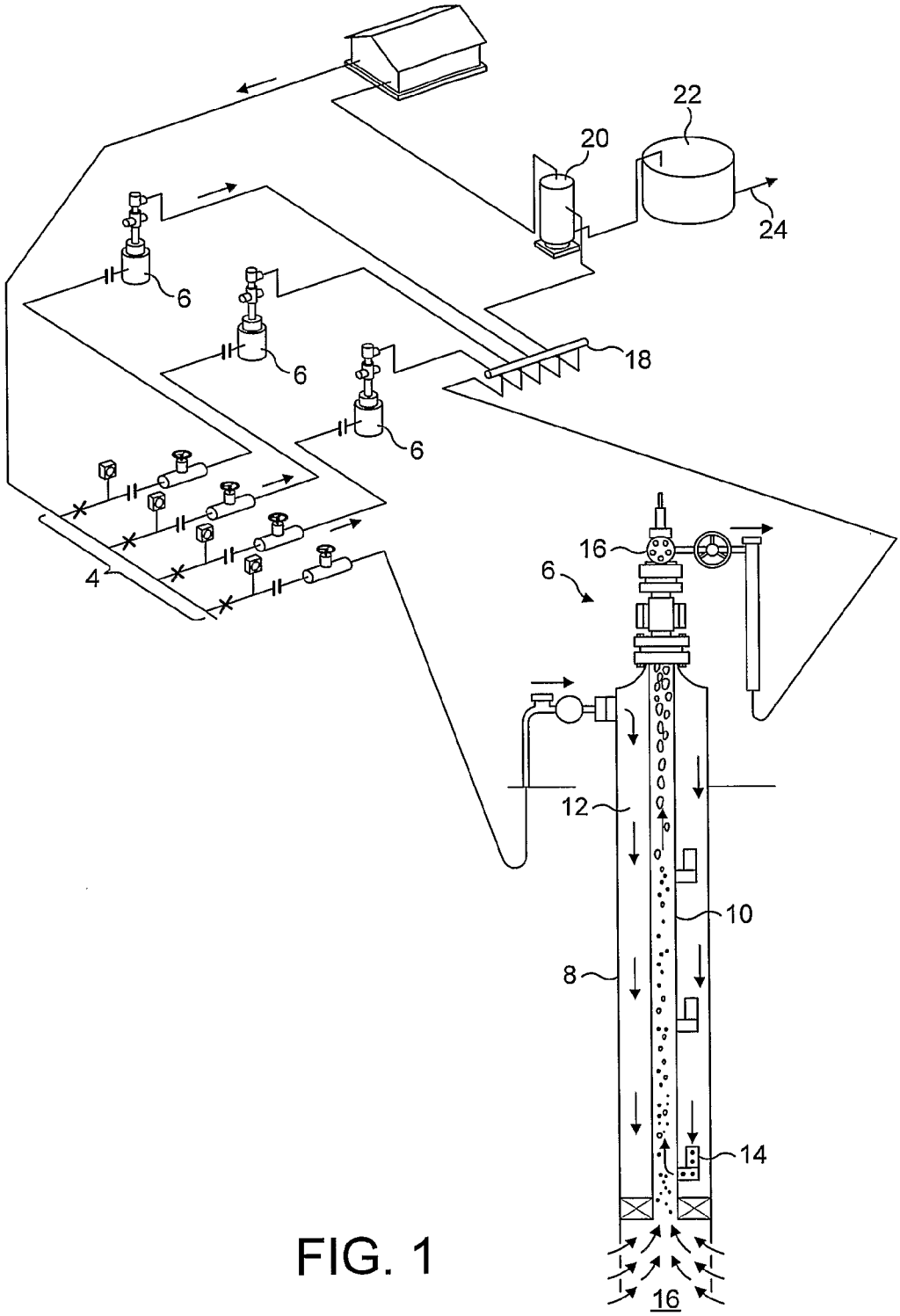
FIG. 1 is a schematic diagram of a typical gas lift oil extraction configuration.
Figure 2:
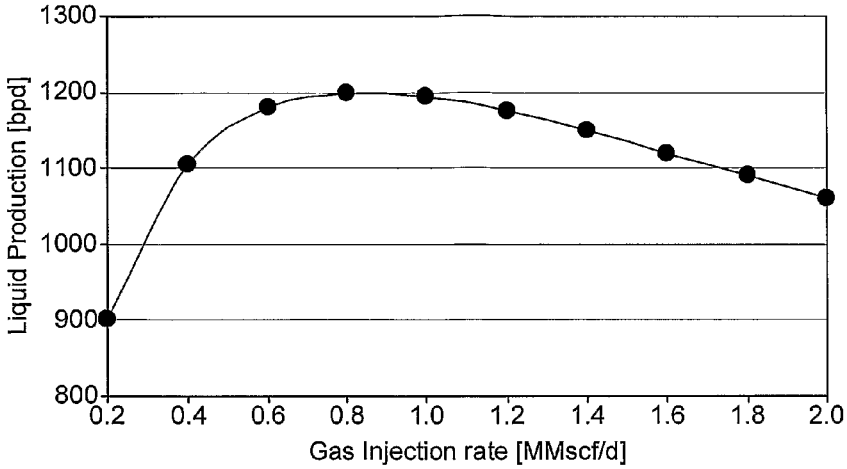
FIG. 2 is a graph showing a plot of liquid production rate against gas injection.
Figure 3A:
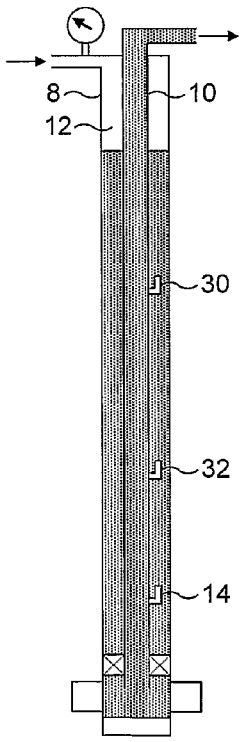
FIGS. 3A to 3C are side cross-sectional views of a well-bore at successive stages during an unloading procedure.
Figure 3B:
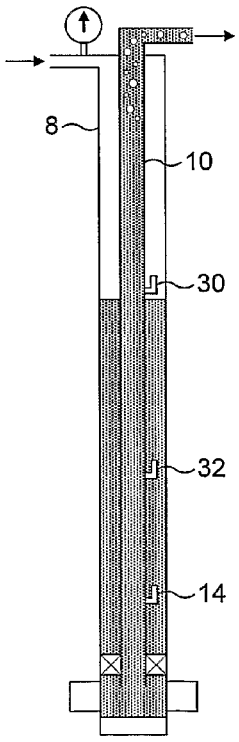
Figure 3C:
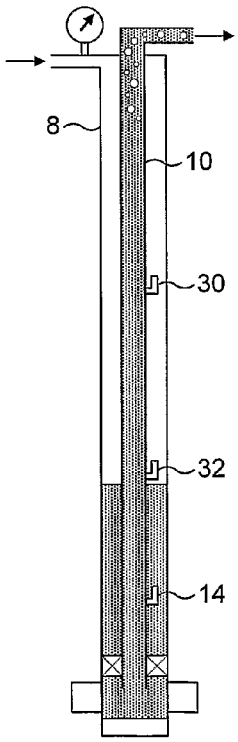
Figure 4:
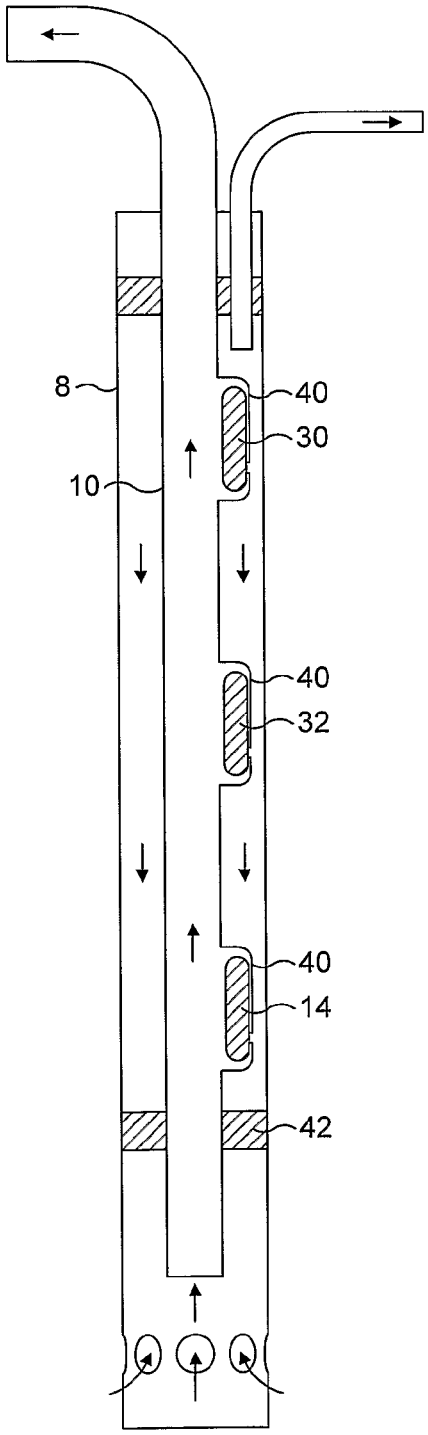
FIG. 4 is a perspective cross-sectional view of a known gas lift configuration.
Figure 5:
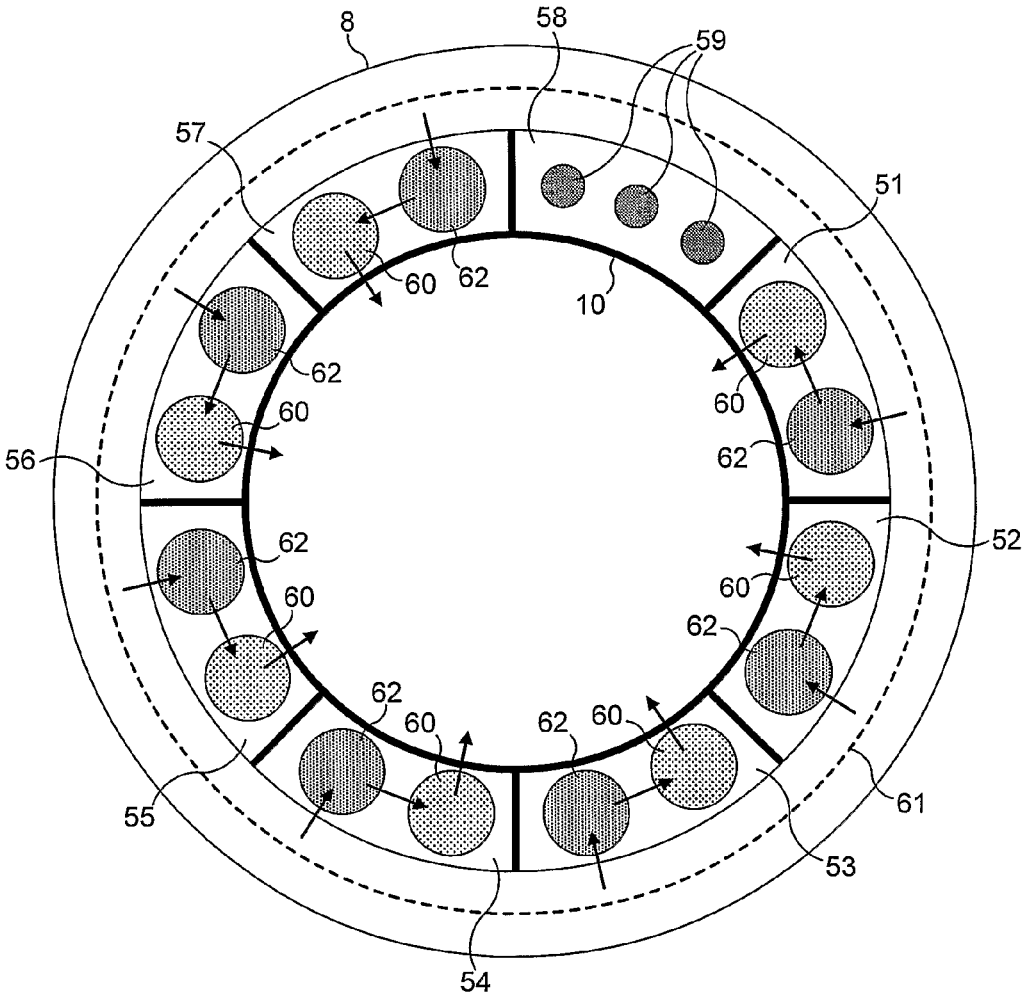
FIG. 5 is a transverse cross-sectional view of a gas injection control device embodying the invention.

FIG. 5 depicts a transverse cross-section through a gas injection control device 50 embodying the invention. It is shown within a well-bore casing 8, the diameter of which may vary from location to location. In the illustrated example it has a diameter of 178 mm (which provides a clearance between the device and the casing 8 to allow fluid flow past the outside of the device), and surrounds a tubing string having a diameter of 90 mm. Dashed circle 61 indicates the working space diameter available for inclusion of the control device (here 152 mm), having regard to variations in well bore diameter and alignment.

The control device 50 is divided into eight equal segments 51 to 58 within a housing 49. Each of segments 51 to 56 contains a control valve arrangement as discussed further below, each of which includes two valves 60,62.

Segment 57 contains an unloading valve arrangement. Segment 58 is shown with three cables 59 passing through it, by way of example. This additional segment allows cables, hydraulic pressure lines, and/or other connectors to pass the device and extend to other devices lower down the well bore.

Figure 6:
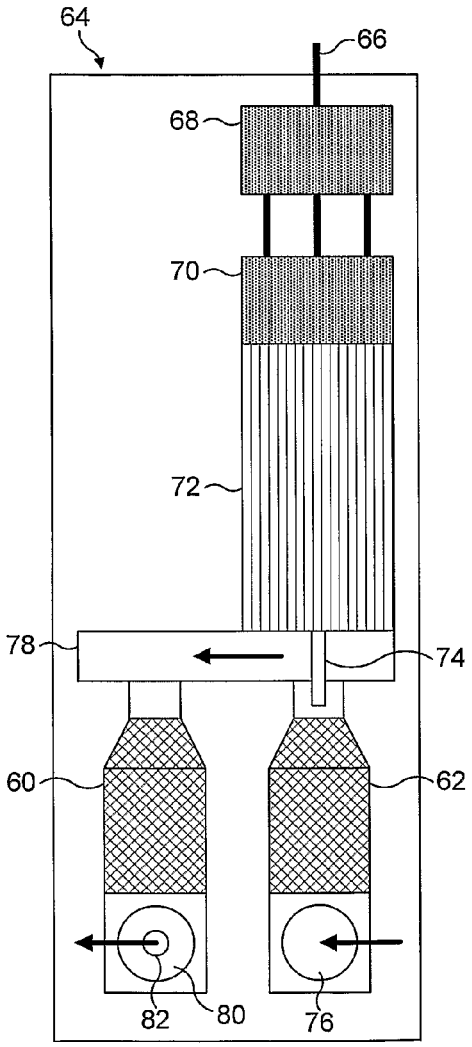
FIG. 6 is a longitudinal cross-sectional view of a control valve arrangement for a control device embodying the invention.
Figure 7:
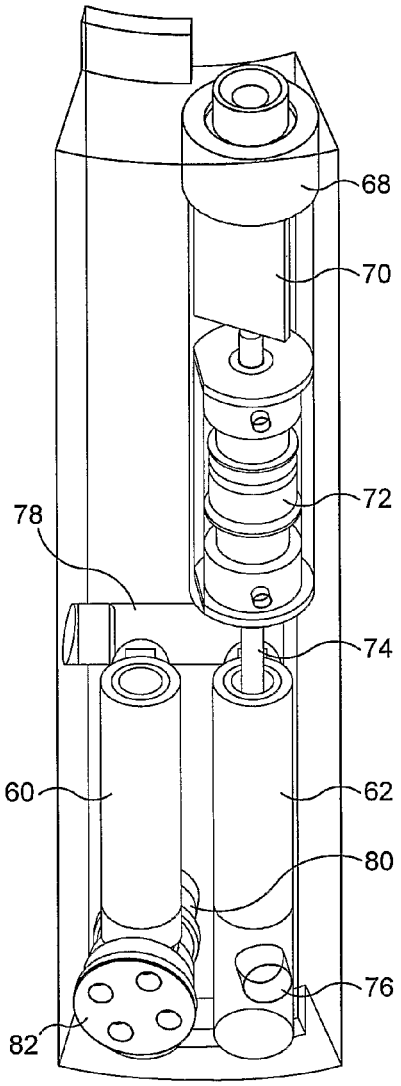
FIG. 7 is a perspective view of the control valve arrangement of FIG. 6.

A longitudinal cross-sectional view through a control valve arrangement 64 for inclusion in a control device 50 embodying the invention is shown in FIG. 6, and a partially transparent perspective view of the same valve arrangement is shown in FIG. 7.

Control signals are fed to the valve arrangement via a cable 66. The cable is coupled to a connector 68. Control signals are fed from the cable via connector 68 to electronic control circuitry 70.

Control circuitry 70 is in turn electrically connected to a bistable actuator 72. The actuator is operable to extend push rod 74 downwardly so as to open inlet check valve 62. This opens a fluid path from an inlet port 76 to a gas channel 78.

Bistable actuators of a form suitable for use in embodiments of the present control device are described for example in United Kingdom Patent Nos. 2342504 and 2380065, United Kingdom Patent Application No. 0822760.5, and U.S. Pat. No. 6,598,621, the contents of which are incorporated herein by reference.

Gas channel 78 defines a fluid path between inlet valve 62 and safety check valve 60. Valve 60 is provided between the gas channel 78 and an outlet port 80. A flow restrictor 82 is provided in the outlet port which defines an orifice that determines the rate at which gas is able to pass through the outlet port. The components of the valve arrangement are provided within a body 84, formed of a metal such as stainless steel for example.

With a bistable actuator, no power is required to maintain the valve in a selected open or closed position and only a short pulse is needed to switch it to the other position. This means that cable 66 may be relatively lightweight, making it easier to handle and deploy. This is particularly significant when it extends over a substantial distance to the seabed, for example, which could be several kilometers.

In operation of the valve arrangement shown in FIGS. 6 and 7, when it is required to perform gas injection, an appropriate signal is fed to the arrangement along cable 66, via control circuitry 70 to the actuator 72. The actuator operates to open inlet valve 62, allowing pressurized gas from the well-bore annulus into inlet port 76. Pressurized gas flows then through inlet valve 62 and gas channel 78, and the resultant pressure on safety valve 60 causes the valve to open leading to injection of gas through the wall of the tubing string via outlet port 80.

The table of FIG. 8 illustrates how six valve control arrangements may be provided and operated in a gas injection control device embodying the invention in such a way as to facilitate control of the rate of gas injection at 5% increments. Two of the valves allow 5% of the maximum flow when open, two allow 15% each and the two remaining valves allow 30% each. Selectively opening the valves in different combinations as shown in FIG. 8 enables the desired percentage of the maximum flow rate to be injected. A seventh valve is identified in FIG. 8 which represents a dump or unloading valve for allowing high flow rate injection as discussed herein.

An alternative configuration is shown in the table of FIG. 9. Here, the six valve control arrangements each allow approximately one sixth of the maximum flow when open. In this embodiment an additional dump valve is not included and unloading is achieved by opening all six valves at the same time. Opening all the control valves may facilitate quicker unloading in comparison to switching to a separate unloading valve.

Figure 10:
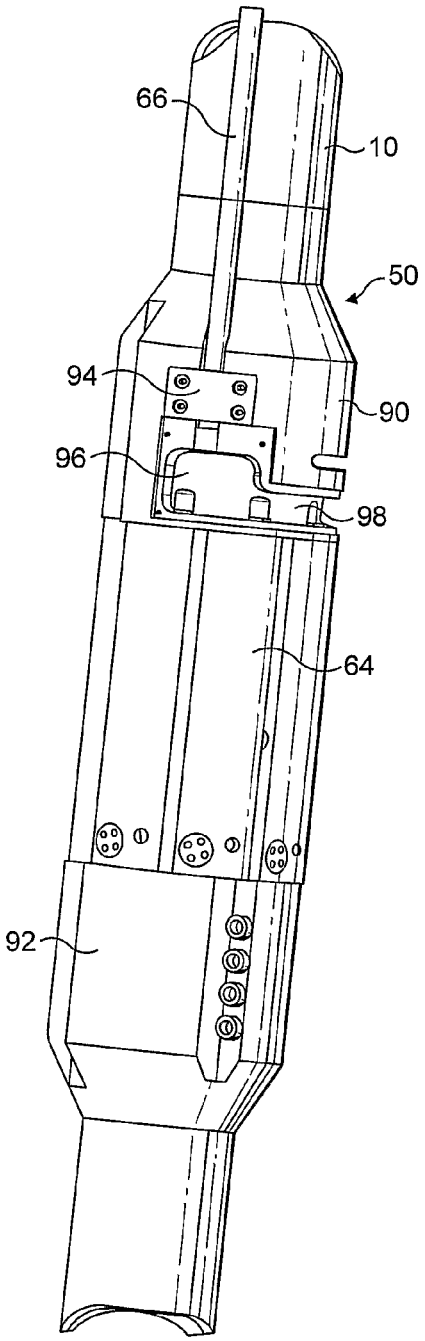
FIGS. 10 and 11 are side views of a gas injection control device embodying the invention.
Figure 11:
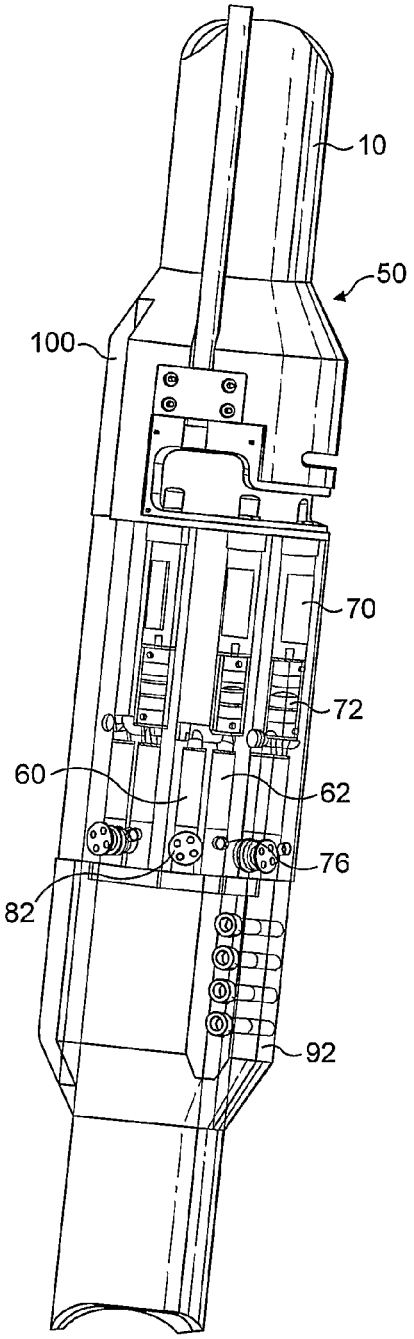

FIGS. 10 and 11 show a gas injection control device embodying the invention installed around a tubing string 10.

Upper and lower clamping collars 90,92 serve to secure the device in position. A cable clamp on the upper clamping collar 94 restrains the cable 66. The portion of the cable extending beyond the clamp 94 is not shown in the Figures. It passes into cable termination pocket 96 and wiring channel 98 from where it couples to each valve arrangement in turn. In practice, the cable termination pocket and wiring channel will be covered by a sheet metal cover and filled with a potting compound to seal and protect against vibration.

A cable bypass section 100 is defined along the length of the control device to allow cables and/or other control or supply lines to extend past the device to other devices lower down the tubing string. In some cases there may be fewer valve control arrangements and more space available instead for bypass use in a device.

A flow restrictor in the form of a venturi port 82 is provided in each outlet port 80. This may be configured as a removable plug, insertable via the outer circumferential surface of the control device. In this way, the port size can be readily selected and defined independently in each valve control arrangement of the device according to the specific requirements of the well bore concerned, by insertion of an appropriate plug in each arrangement. Selection of the port sizes may therefore be carried out on site, shortly before deployment of the device, rather than during its assembly, so that information regarding the characteristics of the particular well bore concerned can be taken into account.

In the case of an unloading valve, the plug may merely seal the orifice it is received in at the outside, and not otherwise restrict the path of the injection gas into the tubing string.

Figure 12:
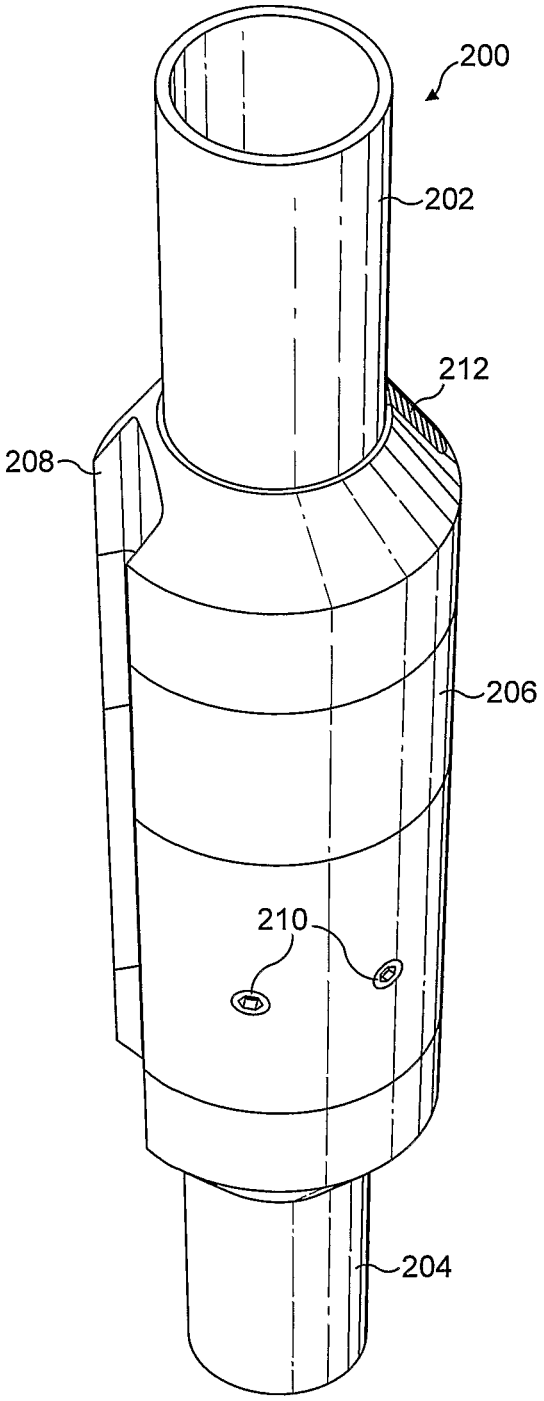
FIG. 12 is a perspective view of another gas injection control device embodying the invention.
Figure 13:
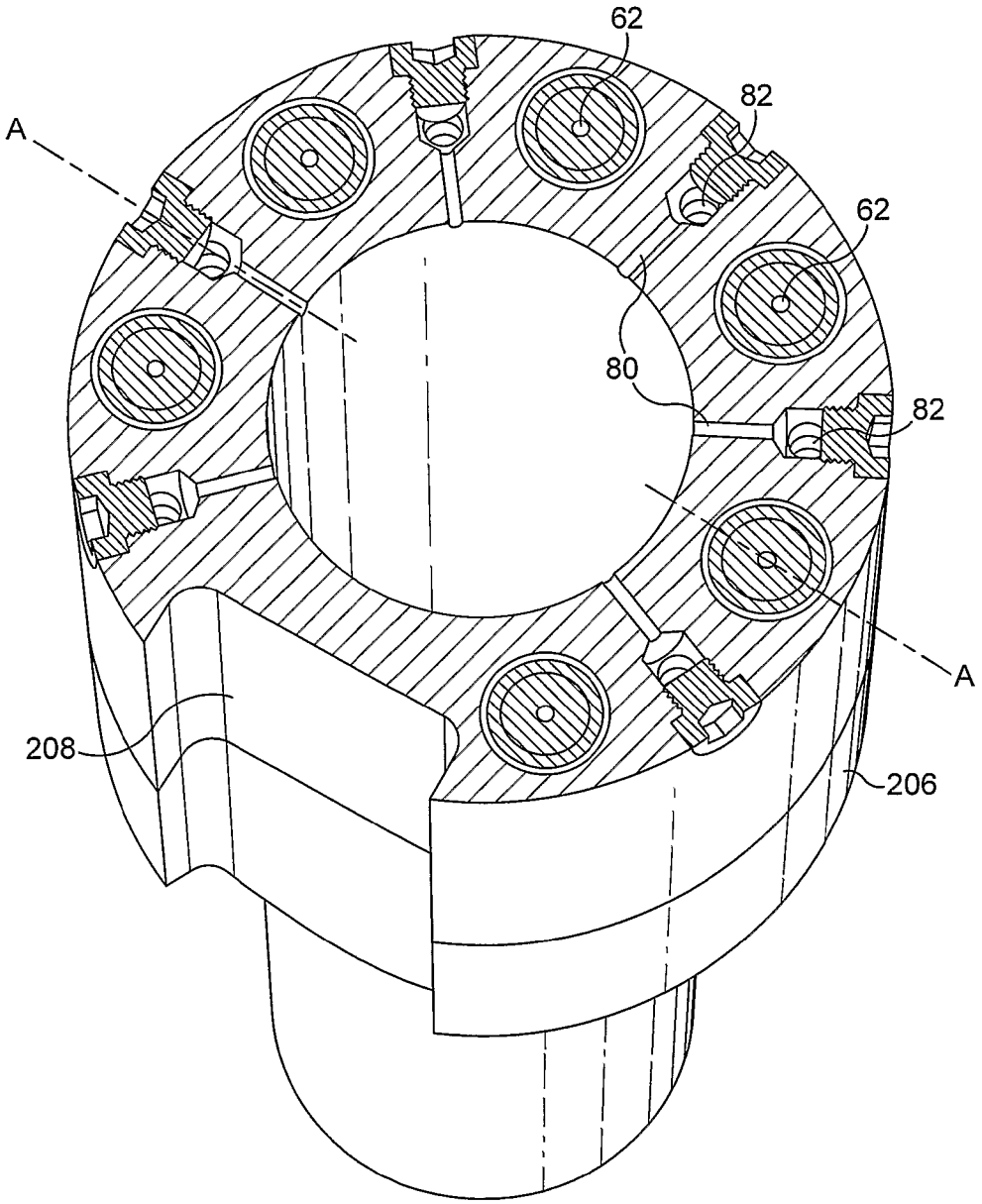
FIG. 13 is a perspective transverse cross-sectional view of the device of FIG. 12.
Figure 14:
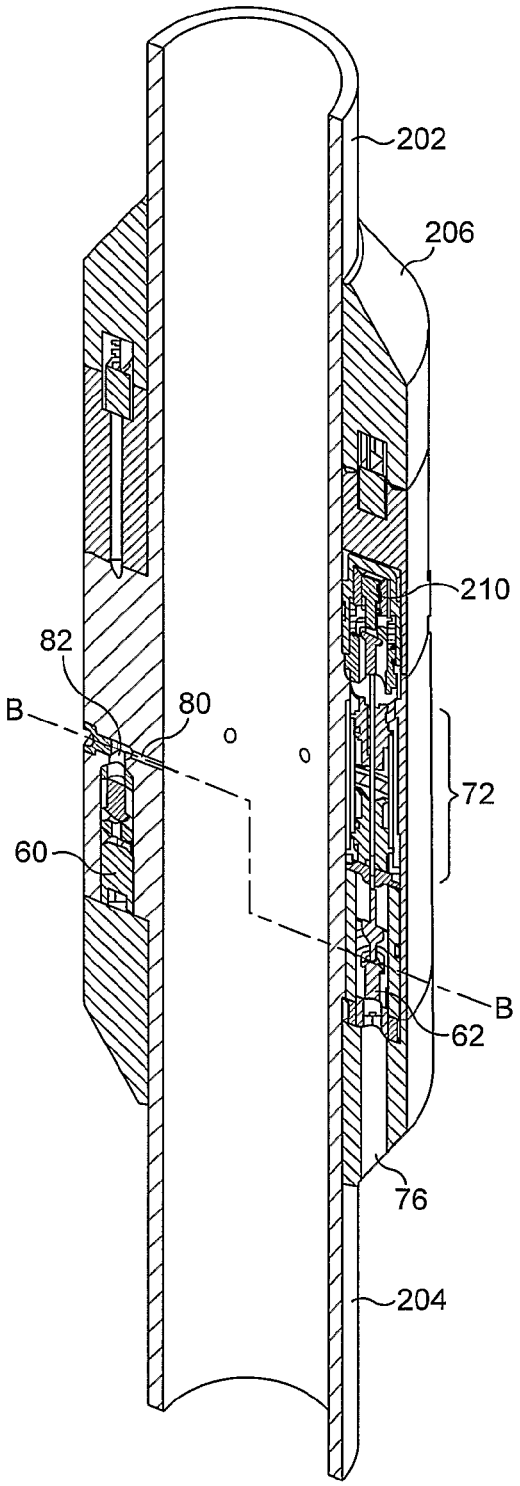
FIG. 14 is a perspective longitudinal cross-sectional view of the device of FIG. 12.

FIGS. 12 to 14 relate to a further embodiment of the invention. In contrast to the configuration described above which is arranged for deployment around an oil production tube, this further embodiment is configured to be inserted into the tubing string, between adjacent tube portions. The gas injection control device 200 to which FIGS. 12 to 14 relate includes tubular sections 202 and 204 at opposite ends of its housing for connection to adjacent portions of the production tube using appropriate couplings (not shown in the Figures). The tubular sections 202, 204 together with the housing 206 define a fluid path along the axis of the device for crude oil being drawn up the production tube.

The housing 206 is formed as a solid body with cavities therein to hold components associated with gas flow control. This solid construction protects these components from the substantial ambient pressure in the well bore environment.

The outer surface of the housing 206 defines a bypass slot 208 extending longitudinally along the housing. This provides space for cables and/or pipes to extend past the gas control device to reach other equipment deployed further down the well bore below the control device.

As is the case in the first embodiment described above, individual flow restrictors 210 of the device are accessible externally of the device to facilitate installation and/or replacement of one or more of the restrictors in the field, just prior to deployment of the control device. This allows a selection of the restrictors by the user to suit the specific requirements of a given well.

Control cables for the gas control device enter the housing 206 via a sealed electric cable inlet 212. In a preferred configuration, two control wires are sufficient. They provide a dual function. The wires provide a low DC current trickle charge to a storage capacitor within the housing 206. They are also employed to carry control signals to the device and transmit information back from the device to the surface.

The control wires may extend from the surface to the device within a protective tube formed of steel for example. The interior of the tube may be sealed against its surroundings and coupled to a cavity in the control device containing control electronics, with the interior of the tube and cavity at the surface atmospheric pressure. This facilitates use of standard components for the electronics, rather than requiring more expensive components able to operate at the high pressure experienced in the well bore.

A transverse cross-section through the housing 206 is shown in FIG. 13. In the embodiment depicted, six control valve arrangements are provided within the solid housing. The configuration of valves and actuators in the control arrangements is similar to that described above in relation to the embodiment of FIGS. 5 to 7. In the cross-section of FIG. 13, each inlet check valve 62 is visible, alongside the flow restrictors 82 which are in fluid communication with respective gas injection outlet ports 80.

FIG. 14 shows a longitudinal cross-sectional view through the gas control device of FIGS. 12 and 13. The plane of the transverse cross-section through the inlet check valves 62 and flow restrictors 82 depicted in FIG. 13 is marked by a line B-B in FIG. 14. The cross-sectional plane of FIG. 14 passes through line A-A marked on FIG. 13.

The bistable actuator 72 associated with each inlet valve 62 is visible in FIG. 14. An upper pressurised cavity 210 is defined by the housing 206 adjacent the end of the actuator 72 opposite to the inlet valve 62. The inlet check valve 62 is exposed to the ambient hydrostatic pressure via its inlet port 76. The cavity 210 is also exposed to the same ambient pressure to ensure that the pressure on either side of the actuator 72 is balanced. This is to avoid the ambient pressure forcing the inlet valve open by overcoming the force applied by the actuator 72.

The invention claimed is:

1. A gas injection control device for deployment in a wellbore to control injection of gas into a tube containing crude oil to lift the oil up the tube, comprising a housing and at least two control valve arrangements within the housing, each control valve arrangement having:

an inlet for receiving gas from a pressurized supply;

an outlet for supplying pressurized gas for injection into said tube;

an inlet valve in a fluid path between the inlet and outlet;

a bistable electrical actuator that is associated with the inlet valve and is independently controllable to switch the respective inlet valve between its open and closed configurations; and a removable flow restrictor that is insertable in the outlet of that control valve arrangement via an outer circumferential surface of the control device.

2. A device of claim 1, wherein at least two control valve arrangements are provided which are configured to supply gas at different flow rates to each other at their outlets when their inlets are connected to a common gas supply, and each of two of the at least two the control valve arrangements is one of a pair of control valve arrangements, with the arrangements in each pair being configured to supply gas at substantially the same flow rate at their outlets when their inlets are connected to a common gas supply.

3. A device of claim 1, wherein the housing has a substantially annular configuration for deployment around a tubing string.

4. A device of claim 1, wherein the device is arranged to be coupled in use between portions of a tube, and define a path for the oil which is between the portions of tube.

5. A device of claim 1, wherein each control valve arrangement includes a safety valve in the fluid path between its outlet and the inlet valve, with the safety valve arranged so as to inhibit fluid from flowing into the arrangement via its outlet.

6. A device of claim 1, including an unloading valve arrangement for selectively allowing a substantially higher flow rate to said tube than the control valve arrangements.

7. A device of claim 1 that has three pairs of control valve arrangements, with each arrangement of the first, second, and third pairs configured to supply approximately 5%, 15%, and 30% of a maximum flow rate of a device, respectively.

8. A gas injection control device for deployment in a wellbore to control injection of gas into a tube containing crude oil to lift the oil up the tube, comprising a housing, and at least two control valve arrangements within the housing, each arrangement having:

an inlet for receiving gas from a pressurized supply;

an outlet for supplying pressurized gas for injection into said tube;

an inlet valve in a fluid path between the inlet and outlet; and an actuator associated with the inlet valve, each actuator being independently controllable to switch the respective inlet valve between its open and closed configurations, wherein each control valve arrangement includes a removable flow restrictor in its outlet and the flow restrictors are insertable via an outer circumferential surface of the control device.

9. A device of claim 8, wherein at least two control valve arrangements are provided which are configured to supply gas at different flow rates to each other at their outlets when their inlets are connected to a common gas supply, and each of the at least two of the control valve arrangements is one of a pair of control valve arrangements, with the arrangements in each pair being configured to supply gas at substantially the same flow rate at their outlets when their inlets are connected to a common as supply.

10. A device of claim 8, wherein the housing has a substantially annular configuration for deployment around a tube.

11. A device of claim 8, wherein the device is arranged to be coupled in use between portions of a tube, and define a path for the oil which is between the portions of tube.

12. A device of claim 8, wherein each control valve arrangement includes a safety valve in the fluid path between its outlet and the inlet valve, with the safety valve arranged so as to inhibit fluid from flowing into the arrangement via its outlet.

13. A device of claim 8, including an unloading valve arrangement for selectively allowing a substantially higher flow rate to said tube than the control valve arrangements.

14. A device of claim 8 that has three pairs of control valve arrangements, with each arrangement of the first, second and third pairs configured to supply approximately 5%, 15% and 30% of a maximum flow rate of the device, respectively.

15. A method for controlling injection of gas into a tube containing crude oil to lift the oil up the tube, comprising the steps of:

providing a gas injection control device comprising a housing and at least two control valve arrangements within the housing, each arrangement having an inlet for receiving gas from a pressurized supply, an outlet for supplying pressurized gas for injection into the tube, an inlet valve in a fluid path between the inlet and outlet, and a bistable electrical actuator associated with the inlet valve, each actuator being independently controllable to switch the respective inlet valve between its open and closed configurations;

selecting a removable flow restrictor for each outlet according to the port size required for the respective control valve arrangement;

inserting each flow restrictor in the respective outlet via an outer circumferential surface of the device;

coupling the outlet of each arrangement to the interior of the tube; and selectively operating each bistable actuator so as to inject gas into the tube at a desired combined rate.

16. A method of claim 15 including the further steps of: monitoring the output flow rate of the tube; and adjusting the rate of injection of gas into the tube in response to the monitored output flow rate.

17. A method for controlling the extraction of crude oil via multiple tubes, comprising carrying out the steps of claim 15 in relation to each tube; monitoring the output flow rate of each tube; and adjusting the rate of injection of gas into at least one tube in response to the monitored output flow rates.

18. A method for controlling injection of gas into a tube containing crude oil to lift the oil up the tube, comprising the steps of:

providing a gas injection control device comprising a housing and at least two control valve arrangements within the housing, each arrangement having an inlet for receiving gas from a pressurized supply, an outlet for supplying pressurized gas for injection into the tube, an inlet valve in a fluid path between the inlet and outlet, and an actuator associated with the inlet valve, each actuator being independently controllable to switch the respective inlet valve between its open and closed configurations;

selecting a removable flow restrictor for each outlet according to the port size required for the respective control valve arrangement;

inserting each flow restrictor in the respective outlet via an outer circumferential surface of the device;

coupling the outlet of each arrangement to the interior of the tube; and selectively operating each actuator so as to inject gas into the tube at a desired combined rate.

19. A method of claim 18 including the further steps of: monitoring the output flow rate of the tube; and adjusting the rate of injection of gas into the tube in response to the monitored output flow rate.

20. A method for controlling the extraction of crude oil via multiple tubes, comprising carrying out the steps of claim 18 in relation to each tube;

monitoring the output flow rate of each tube; and adjusting the rate of injection of gas into at least one tube in response to the monitored output flow rates.

21. A gas injection control device for deployment in a well-bore to control injection of gas into a tube containing crude oil to lift the oil up the tube, comprising a housing and at least three pairs of control valve arrangements within the housing, each control valve arrangement having:

an inlet for receiving gas from a pressurized supply;

an outlet for supplying pressurized gas for injection into said tube;

an inlet valve in a fluid path between the inlet and outlet; and a bistable electrical actuator that is associated with the inlet valve and is independently controllable to switch that the respective inlet valve between its open and closed configurations; and each of the first pair of control valve arrangements being configured to supply approximately 5% of the maximum flow rate of the device, each of the second pair of control valve arrangements being configured to supply approximately 15% of the maximum flow rate of the device, and each of the third pair of control valve arrangements being configured to supply approximately 30% of the maximum flow rate of the device.

* * * * *

UNITED STATES PATENT AND TRADEMARK OFFICE

CERTIFICATE OF CORRECTION

PATENT NO. : 8,925,638 B2
APPLICATION NO. : 12/995754
DATED : January 6, 2015
INVENTOR(S) : Wladyslaw Wygnanski It is certified that error appears in the above-identified patent and that said Letters Patent is hereby corrected as shown below:

In the Claims:

At Column 8, line 47, "as supply." should be -- gas supply. --.

Signed and Sealed this
Third Day of November, 2015

Michelle K. Lee

Michelle K. Lee
*Director of the United States Patent and Trademark Office*